United States Patent [19]

Hein, Jr.

[11] 4,046,316

[45] Sept. 6, 1977

[54] SNAP RING MAGNETIC STOPPING SYSTEM FOR AN AIR DRIVEN CENTRIFUGE

[76] Inventor: George Norton Hein, Jr., 331 Chesham Ave., San Carlos, Calif. 94070

[21] Appl. No.: 681,311

[22] Filed: Apr. 29, 1976

[51] Int. Cl.[2] ..... B04B 9/14

[52] U.S. Cl. ..... 233/23 R; 233/1 C; 74/5.43; 415/123; 188/164; 310/105

[58] Field of Search ..... 233/23 R, 23 A, 24, 233/1 R, 27, 1 C; 74/5.43, 5.46; 188/164; 415/123; 310/105; 210/146

[56] References Cited

U.S. PATENT DOCUMENTS

| | | | |
|---|---|---|---|
| 2,106,609 | 1/1938 | Krauss | 233/24 X |
| 2,213,107 | 8/1940 | McBain | 233/23 R |
| 2,872,104 | 2/1959 | Cizinsky | 233/23 R |
| 3,064,149 | 11/1962 | Baermann | 310/105 X |
| 3,447,006 | 5/1969 | Bair | 310/105 X |
| 3,845,995 | 11/1974 | Wehde | 74/5.46 X |
| 3,902,659 | 9/1975 | Brinkmann et al. | 310/105 X |
| 3,958,753 | 5/1976 | Durland et al. | 233/23 R |

*Primary Examiner*—George H. Krizmanich
*Attorney, Agent, or Firm*—Robert J. Steinmeyer; Ferd L. Mehlhoff; William H. May

[57] ABSTRACT

A stopping member located within an air driven rotor and designed to respond to a magnetic field generated within the rotor housing, causing the completer stoppage of the rotor subsequent to its high speed centrifugation. The stopping member is comprised of a ferrous metal element positioned within the rotor for alignment with the poles of a magnet to facilitate sufficient attractive forces between the magnet and the metal element to completely stop the rotative motion of the rotor on a support cushion of air.

5 Claims, 4 Drawing Figures

SNAP RING MAGNETIC STOPPING SYSTEM FOR AN AIR DRIVEN CENTRIFUGE

BACKGROUND OF THE INVENTION

The present invention is related to braking systems for use on air driven centrifuges and more particularly is related to a means for providing a complete stop to the rotation of the rotor on its cushion of air.

During the centrifugation operation of an air driven centrifuge the rotor typically reaches extremely high rotational speeds in the neighborhood of 150,000 to 200,000 r.p.m.'s. Because the rotor is operating on a virtually friction free cushion of air, the rotor will continue to rotate at very high rotational speeds for a period of time subsequent to the operation of the air driving jets. The cushion of support air is supplied by a support stream of air, which tends in some centrifuge arrangements to exert a slight continued rotational effect on the rotor due to the interaction of the rotor flutes with the supporting air stream.

Once a fluid mixture has been subjected to centrifugation and certain constituents of the mixture have been separated, it is extremely important that the rotor not be subjected to any unstable or jerking motions during its deceleration to a stop. Otherwise, the separated constituents may become remixed, requiring another centrifugation operation. One source of possible unwanted jerking motion is making the rotor stop too quickly or almost instantaneously. Consequently, it is desirable to have the rotor slow somewhat gradually before coming to a stop.

Some prior art methods of stopping the rotor utilize mechanisms which physically contact the rotor, resulting in the frictional wearing of the parts and requring maintenance as well as introducing an additional parameter or effect upon the rotor which may contribute to additional vibrations or wobbling in the rotor that could remix the centrifuged sample.

In certain rotor arrangements, such as shown in my copending application filed on an even date herewith entitled Centrifuge Rotor for Separating Phases of a Liquid, the rotor has a chamber in which the separated constituents are sealed from the remainder of the mixture to alleviate the concern of remixing. Therefore, the need for a gradual deceleration with such a rotor is eliminated, permitting extremely quick stoppage of the rotor. In one quick braking apparatus the flow of the driving air jets is reversed to counter the rotational speed of the rotor to stop the rotational speed of the rotor, but the incident effects of the reversing air flow on the flutes of the rotor prevent the ability to completely stop the rotational movement. Another approach is set forth in a copending application by Douglas H. Durland, George N. Hein, Jr. and Robert J. Ehret filed on even date herewith entitled Eddy Current Brake for an Air Centrifuge. Here a magnetic field is utilized to create eddy currents within the rotor, causing it to quickly decelerate and almost completely stop. However, the rotor will continue to rotate slightly at approximately five to 10 revolutions per second, because there is generally always some slight turning effect placed on the rotor by the supporting air flowing over the rotor flutes.

In order to facilitate convenient removal of the rotor from the centrifuge it is desirable to bring the rotor to a complete stop while it is being supported on a cushion of air. Otherwise, since the rotor subsequent to deceleration continues to rotate at approximately five to 10 revolutions per second due to the supporting air, stopping of the supporting air with the resulting spinning contact of the rotor onto the rotor seat will tend to cause the rotor to thrash around within the rotor seat. If the centrifuged sample within the rotor is susceptible to remixing, the sudden contact of the rotor with the rotor seat will cause an undesired remixing of the sample.

Therefore, a rotor which is riding on a cushion of air during deceleration must be brought to a complete stop subsequent to either a gradual or quick deceleration before turning off the supporting air and allowing the rotor to contact the rotor seat.

SUMMARY OF THE INVENTION

The present invention comprises a stopping element positioned within an air driven centrifuge rotor for reaction with a magnetic field placed within the rotor housing adjacent the rotor. The stopping element is comprised of ferrous metal which is sufficiently attracted to the magnetic field to cause the rotor to come to a complete stop. The combined operation of the magnetic field and the ferrous metal stopping element provides not only the gradual and reasonably quick deceleration of the rotor, but also the complete stoppage of the rotor, allowing it to come to rest on the rotor seat without causing any remixing of the centrifugated constituents.

Further, the present invention comprises the use of the stopping element with the braking apparatus set forth in the previously referenced copending application for An Eddy Current Brake in An Air Driven Centrifuge. The stopping element of ferrous metal located in the rotor provides a sufficient attraction between the magnetic field and the rotor to cause the rotor to come to a complete stop, overcoming the lingering effects of the supporting air which tends to continue rotation of the rotor. This will enable the braking apparatus, using eddy currents, to decelerate and completely stop the sealed chamber rotor in approximately eight to ten seconds.

The use of the present stopping element in conjunction with a magnetic field will achieve the desired goal of having the air cushioned rotor, which is susceptible to remixing, gradually decelerate and come to a complete stop subsequent to the high speed centrifugation operation within a reasonably fast period of time, approximately five minutes, which is considerably faster than allowing the rotor to coast to a stop on the cushion of supporting air.

DETAILED DESCRIPTION OF THE INVENTION

Figure 1:
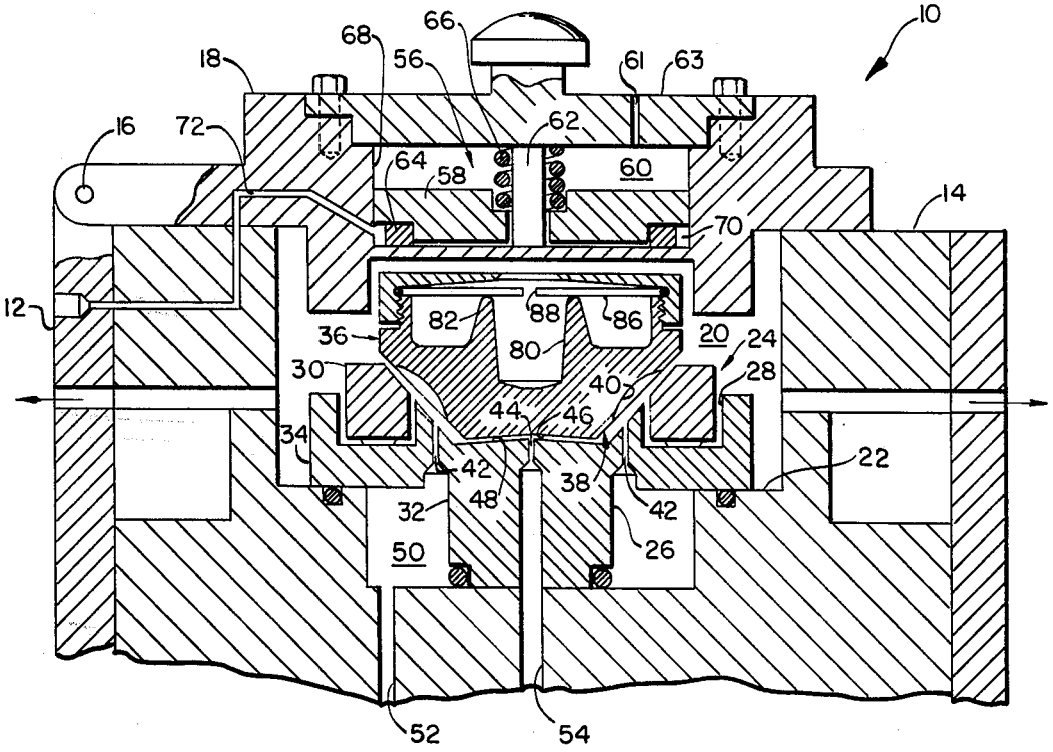
FIG. 1 is an elevation sectional view of an air driven centrifuge rotor incorporating the present invention located in the rotor housing.

In FIG. 1 a centrifuge device 10 is shown having an outer casing 12 and a housing 14. Pivotally mounted to the outer casing 12 on a pivot junction 16 is a cover 18 which rests on the housing 14 to enclose the rotor chamber 20. Located adjacent the bottom 22 of the chamber 20 is rotor seat 24 with a stator body 26, having an annular groove 28 for receipt of a stator pad 30. The stator body 26 has a central depending portion 32 and an annular flange portion 34 which carries the stator pad 30.

Positioned within the rotor chamber 20 is a rotor 36 which is in the preferred embodiment approximately 1½ inches in diameter and has a frustoconically shaped lower portion 38 situated in the rotor seat 24. Frustoconical portion 38 of the rotor 36 has a series of flutes 40 which are designed to receive impinging air streams from the driving air jets 42 inthe stator body for rotating the rotor at high rotational speeds.

The center of the stator body 26 has an air support jet 44 which supplies a supporting cushion of air between the rotor seat 24 and the rotor 36 when the air driving jets 42 are not operating. Further detail as to the recessed conical surface 46 in the rotor 36 and the conical projection 48 in the center of the stator body 26, which in conjunction with the support jet 44 contribute to the stable rotation of the rotor is found in my copending patent application filed on even date herewith entitled An Air Levitation System for Air Driven Centrifuge. Pressurized air to the air driving jets 42 is supplied through an annular manifold 50 in fluid communication with a driving air supply passage 52 while the pressurized air supply to the air support jet 44 enters through the support air supply passage 54.

Located within the centrifuge cover 18 is a braking apparatus 56 having a nonmagnetic carrier 58 movably mounted within a magnet chamber 60 on a central guide post 62. The carrier 58 holds a magnet or plurality of magnets 64 designed to be moved toward and away from the rotor 36. A spring 66 mounted on the guide post 62 biases the carrier 58 toward the rotor 36. Formed between the magnets 64 and the wall 68 of the magnet chamber 60 is an annular air cavity 70 in fluid communication with a lifting air supply passage 72. When pressurized air is introduced through the air passage 72 and into the annular chamber 70, the carrier 58 will move away from the rotor 36 against the bias of the spring 66, allowing rotation of the rotor by the drive air jets 42. An air vent passage 61 is located in the brake apparatus lid 63. When the air to the passage 72 is stopped and the spring 66 biases the carrier closer to the rotor 36, the rotor experiences a braking action by eddy current build up in the rotor. Further detail regarding the structure and operation of the braking apparatus 56 is found in my previously referenced copending application entitled An Eddy Current Brake in An Air Drive Centrifuge.

Figure 2:
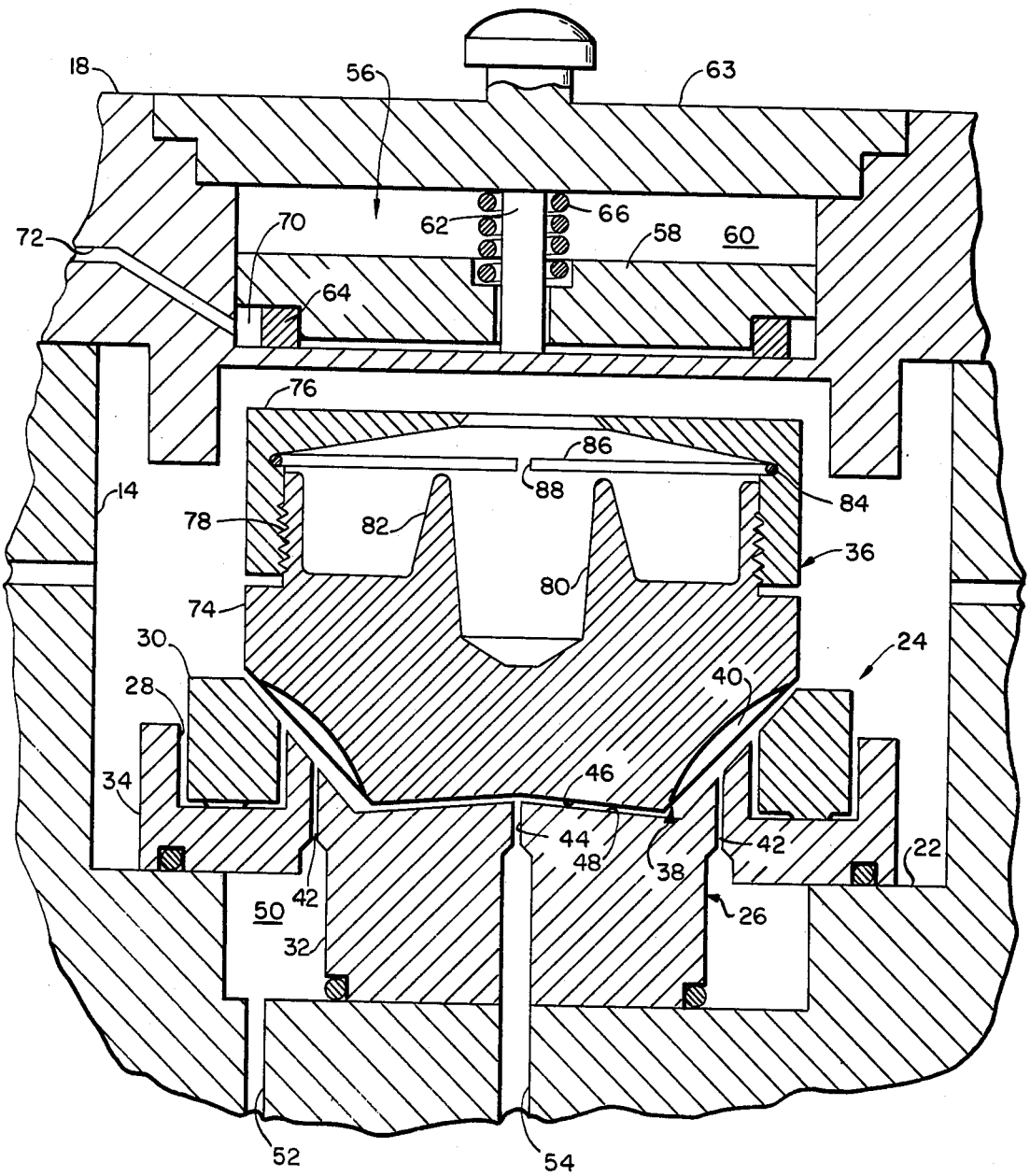
FIG. 2 is a partial sectional view of the housing containing the rotor.

Reference is made to FIG. 2 showing the rotor 36 and the braking apparatus 56 in more detail. The rotor 36 has a lower portion 74 and a cap 76 which are joined together at the threaded junction 78. The lower portion 74 of the rotor has a central cavity 80 and an annular cavity 82 which receive a liner or container (not shown) to form an inner and an annular chamber. Further detail as to the structure of rotor 36 and its liner is disclosed in my copending application, filed on an even data herewith entitled, A Centrifuge Rotor for Separating Phases of a Liquid. The rotor 36 is designed to have one chamber receive and retain the separated constituents of the centrifugated mixture sealed within the chamber as the rotor decelerates.

The rotor cap 76 has an annular groove 84 which receives a snap ring or stopping element 86 that is made of a ferrous metal. The ring 86 has a cut portion 88 in order to facilitate installation of the ring. It should be noted that the ring 86 is positioned to be aligned with the poles of the magnet 64 in the braking apparatus 56.

In operation, the rotor 36 is driven to very high rotational speeds by the air drive jets 42 operating in conjunction with the rotor flutes 40. Air is also being supplied to the lifting air passages 72 to move the carrier 58 and magnet away from the rotor to alleviate possible drag forces on the rotor caused by eddy current formation in the electrically conductive material of the rotor cap 76. Once the centrifugation operation is completed, it is desirable to bring the rotor to an extremely quick and complete stop. Because the rotor 36 has a sealing chamber for retention of the separated constituents there is no concern of remixing due to a sudden and quick stop.

The air to the drive air jets and the lifting air passage is stopped while air is supplied to the support air passage 54 to provide a cushion of supporting air to the stopping rotor. With no air supply in the lifting air passage 72, the spring 66 biases the carrier 58 and the magnet 64 closer to the rotor 36. Since rotor cap 76 is made of an electrically conductive material, the rotative movement of the rotor within the magnetic field of the magnet 64 causes the establishment of eddy currents within the rotor cap. These eddy currents are resistive forces which oppose the motion of the conductive material moving in and out of the magnetic field. The rotor rotating within the magnetic field causes the eddy currents which dissipate or transform the rotor kinetic energy into heat in the rotor cap and cause the rotor to slow rapidly to almost a complete stop. However, because of the lingering effects of the supporting air flowing along the rotor flutes 40 the rotor continues to rotate slightly on the virtually friction free cushion of air and does not come to a complete stop.

The location of the stopping element or snap ring 86 of a ferrous metal aligned with the magnet 64 provides enough attraction to the magnet to cause the rotor to come to a complete stop subsequent to the extremely quick eddy current deceleration. The joint action of the snap ring and the magnet enables the complete stop of the rotor. Therefore, after an extremely short period of time to allow the rotor to stop levitation or supporting air can be turned off, enabling immediate removal of the sample from the rotor.

Figure 3:
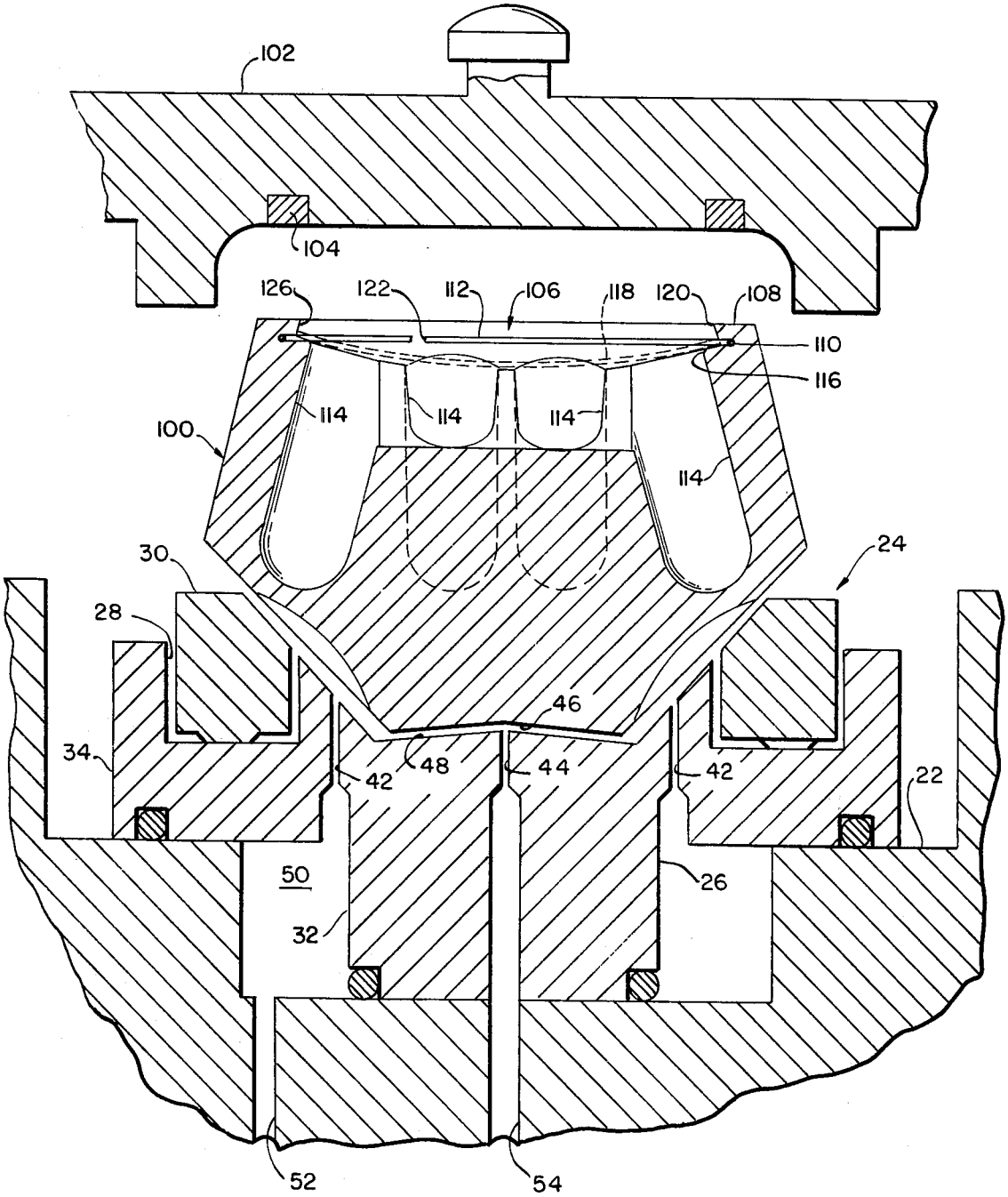
FIG. 3 is a partial sectional view of an alternate embodiment of the present invention.

Another embodiment of the present invention is shown in FIG. 3 with a rotor 100 having a different interior configuration than the rotor 36 in FIGS. 1 and 2. The rotor 100 has the same rotor seat 24; however, the cover 102 to the centrifuge 10 is different from the cover 18 in FIGS. 1 and 2. The cover 102 has a stationary magnet or plurality of magnets 104 positioned a specific distance, approximately 1 inch, from the rotor 100, to afford only slight eddy current drag on rotor 100 and slight magnetic attraction to the ferrous snap ring 110. A central recess 106 is located adjacent the top 108 of the rotor 100. Located within the recess 106 is an annular groove 110 designed to receive the stopping element or snap ring 112 which is aligned with the poles of the magnet 104. Downwardly and outwardly extending from the recess 106 within the rotor 100 are a plurality of cavities 114 designed to receive various samples in liners to be subjected to the centrifugation operation. Positioned within the recess 106 over the upper openings 116 of the respective cavities 114 is a dish-shaped cover 118 (shown in phantom). The cover 118 is preferably made of some flexible material, such as plastic, which is normally flat in its unrestrained configuration and slightly larger in diameter than the diameter of upper opening 120 of the recess area 106. Therefore, when the cover is placed within the recess 106, it will assume its concave or dish-shaped configuration as shown in FIG. 3.

Figure 4:
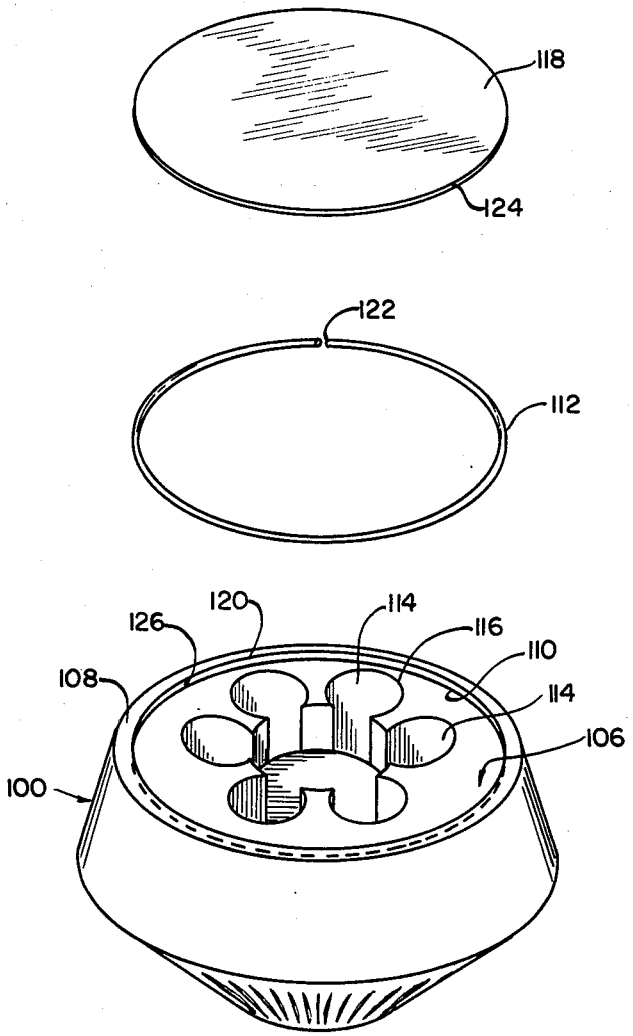
FIG. 4 is an exploded perspective view of the alternate embodiment of the rotor, the sealing member and rotor cover.

Reference is made to FIG. 4 to show in more detail the components of the rotor 100 with its stopping element or snap ring 112 and its cover 118. It should be noted that the snap ring 112 is preferably made of a ferrous metal with a cut at one location 122 to allow more convenient installation into the groove 110. The snap ring is also preferably somewhat flexible to aid in the convenience of installation. The unrestrained orientation of the cover 118 is generally flat. Further, with respect to FIG. 3, when the cover 118 is installed within the recess 106 its outer edge 124 will abut the annular inclined shoulder 126 within the recess 106 to hold the cover 118 in sealing engagement with the upper openings 116 of the respective cavities 114.

In the operation of the second embodiment of the invention the rotor is driven to high rotational speeds by the operation of air drive jets 42 acting in cooperation with the rotor flutes 40. Preferably the rotor 100 is made of a nonmagnetic material, so that eddy current build up as found in the rotor 36 of FIGS. 1 and 2 is present. The magnet 104 is spaced a sufficient distance from the rotor so that the eddy current drag does not adversely affect the centrifugation of the rotor. The driving air jets 42 overcome the eddy current forces and rotate the rotor at the desired high speeds. Because the rotor 100 does not have a sealed chamber to isolate the centrifugated constituents of a sample mixture, it is important that the deceleration of the rotor be somewhat more gradual than the rotor 36 of the first embodiment of the invention in order to avoid too sudden a deceleration which might cause a remixing. Further, the rotor 100 must come to a complete stop before allowing it to come to rest on the rotor seat 24 to avoid remixing from a jerking motion caused by the moving rotor engaging the rotor seat.

Once the air jets 42 are stopped, the eddy current forces induced by the magnet 104 cause the rotor to gradually decelerate. The magnet 104 is spaced a sufficient distance from the rotor so that the deceleration rate is gradual enough to avoid possible remixing of the centrifuged fluid mixture. Further, the magnetic attraction between the magnet 104 and the ring 112 causes the rotor to completely stop subsequent to the eddy current induced deceleration.

It should be noted that the rotor could be driven by other driving means, such as an electromagnetic driving arrangement, instead of the air drive jets 42. Such other driving arrangements would be compatible with the operation of the present invention.

Although both embodiments of the invention show the use of the stopping element 86 or 112 in the form of a ring, it is envisioned that a ferrous member of numerous different configurations could be placed at various locations in the rotor 36 or rotor 100 and function properly as described. Further, the location of the magnet could be varied in the centrifuge housing as desired and still obtain the proper operation of the invention.

What is claimed is:

1. An air driven centrifuge comprising:

a rotor;

air jet means for rotatably driving said rotor;

levitation air jet means for supporting said rotor on a cushion of air when said air jet means is not operating;

means mounted adjacent said rotor for producing a magnetic field; and a ferrous metal element located within said rotor and acting cooperatively with said magnetic field producing means for completely stopping the rotation of said rotor subsequent to the operation of said driving means.

2. An air driven centrifuge as defined in claim 1 wherein said metal element comprises an annular ring.

3. An air driven centrifuge as defined in claim 1, wherein said magnetic field producing means comprises a permanent magnet positioned a specified distance from said rotor.

4. An air driven centrifuge comprising:

a rotor;

means for rotating said rotor;

a rotor cap attached to said rotor, said rotor cap being made of a nonmagnetic material;

a magnet mounted adjacent said rotor and movable between a first and a second position respectively toward and away from said rotor cap; and a ferrous metal element located within said rotor and aligned with said magnet, said magnet in said first position allowing rotative motion of said rotor by said rotating means, said magnet in said second position establishing resistive forces within said rotor cap to decelerate said rotative motion, said metal element reacting to said magnet in said second position to completely stop said rotative motion of said rotor.

5. An air driven centrifuge comprising:

a rotor;

means for rotating said rotor;

a plurality of receptacles within said rotor for receipt of a sample material;

a cover plate positioned within a central recess in the top of said rotor for sealing said plurality of receptacles;

a magnet positioned within said housing adjacent said cover plate; and a ferrous metal element located within said rotor, said metal element cooperatively acting in conjunction with said magnet to decelerate and completely stop the rotation of said rotor when said rotating means is not operating.

* * * * *